US005293990A

United States Patent [19]

Masakayan

[11] Patent Number: 5,293,990

[45] Date of Patent: Mar. 15, 1994

[54] BOX PROTECTION APPARATUS

[76] Inventor: Jose P. S. Masakayan, 8611 Eagle Glen Ter., Fairfax Station, Va. 22039

[21] Appl. No.: 23,637

[22] Filed: Feb. 26, 1993

[51] Int. Cl.[5] ..... A45C 13/10; E05G 5/00; G08B 13/14; B65D 43/14

[52] U.S. Cl. ..... 206/1.5; 109/20; 109/21; 109/31; 116/85; 116/99; 217/66; 220/337; 220/634; 340/571

[58] Field of Search ..... 220/337, 634; 229/125.08, 125.13; 116/85, 99, 211; 217/66; 109/20, 21, 31; 70/DIG. 99; 340/540, 543, 571; 206/1.5

[56] References Cited

U.S. PATENT DOCUMENTS

| | | | |
|---|---|---|---|
| 928,176 | 7/1909 | Brooks | 217/66 |
| 1,331,694 | 2/1920 | Butcher et al. | 116/99 |
| 1,636,458 | 7/1927 | Cheney | 217/66 |
| 2,506,820 | 5/1950 | Webb | 229/125.13 |
| 2,693,895 | 11/1954 | Elmendorf | 217/66 X |
| 2,909,767 | 10/1959 | Zaltman | 109/31 X |
| 3,057,321 | 10/1962 | Pretini | 109/31 X |
| 4,267,553 | 5/1981 | Vogelsanger et al. | 340/571 |
| 4,763,732 | 8/1988 | Neal | 220/377 X |
| 4,799,435 | 1/1989 | Boutroy | 109/20 X |
| 4,940,191 | 7/1990 | Dolby | 229/125.13 X |

*Primary Examiner*—Bryon P. Gehman

*Attorney, Agent, or Firm*—S. Michael Bender

[57] ABSTRACT

A new and improved box protection apparatus includes a plurality of flexible straps for encompassing the box under tension, and a guide for receiving the straps and for orienting the straps with respect to the box. The guide includes a rectangular frame member which includes a plurality of slots for receiving the box-encompassing straps. A hinged lid is provided for covering the frame member. The frame member includes a first locking member, and the lid includes a second locking member whereby the frame member and the lid can be locked together. The frame member includes at least one handle. Buckles are provided for locking the straps under tension, and the buckles are covered by the lid when the lid is locked to the frame member. The box protection apparatus may also include an alarm assembly, connected to either the frame member or the lid, for sounding an alarm in response to unauthorized moving of the lid. A key-controlled override device is provided for preventing the alarm from sounding when an authorized moving of the lid takes place. The box protection apparatus may also include a dye-releasing assembly, connected to the frame member, for releasing dye in response to unauthorized moving of the lid. A key-controlled override device is provided for preventing the dye from being released when an authorized moving of the lid takes place.

14 Claims, 4 Drawing Sheets

BOX PROTECTION APPARATUS

BACKGROUND OF THE INVENTION

1. Field of the Invention

The present invention relates generally to boxes and shipping containers and more particularly, to a method and apparatus especially adapted to effect easy closing, opening, reclosing, and reopening of boxes and shipping containers.

2. Description of the Prior Art

Shipping items by using boxes and similar containers is well known in the art. Often boxes and the like are sealed using ropes, wrapping paper, and tape. The process of closing boxes with ropes, wrapping paper, and tape is often tedious and time consuming.

Moreover, when the boxes are shipped internationally, the boxes may be opened for Customs inspection. In such a case, the ropes, paper, and tape must be removed for box inspection, and, after the inspection is over, the boxes must be reclosed and resealed with the ropes, paper, and tape again. To reseal boxes just after a Customs inspection can be an unpleasant and stressful experience. Often the traveller is under a time pressure to catch another flight or meet persons at the destination, and reclosing and resealing a box may be an unwanted and unpleasant task. Moreover, often the original rope, paper, and tape is damaged or destroyed during removal, is wasted, and must be replaced with new materials when the boxes are reclosed and resealed. Often the traveller does not have any new box closing material readily available, and the boxes may not be reclosed in a satisfactory manner.

In view of the above, it would be desirable if a box closing apparatus were available that permitted easy closing, opening, reclosing, and reopening of the boxes. Also, it would be desirable if a box closing apparatus were available that permitted easy closing, opening, reclosing, and reopening of the boxes and the like without destroying the materials used to close the boxes. In this respect, it would also be desirable if a box closing apparatus were provided which permitted reclosing of opened boxes without the need for new box closing materials. It would also be desirable if a box closing apparatus were provided that is easy to use in a stressful environment such as a Customs inspection.

Another problem associated with shipping boxes relates to security and protection of the valuables that are contained in the boxes. Paper boxes are relatively easy to break into. Moreover, paper boxes often rupture during shipping. In this respect, it would be desirable if a box closing apparatus were provided that provided protection against being broken into. It would also be desirable if a box closing apparatus provided protection against the box rupturing during shipping.

Instead of using ropes, some people employ reusable, adjustable straps for securing boxes. One problem associated with using a plurality of straps is that the straps are generally easy to remove unless locked. Two or more straps would generally be used to secure a box, and two or more locks for the straps would be required. This would necessitate the traveller to be concerned with two or more keys for the locks or, alternatively, to memorize two or more lock combinations. In this respect, it would be desirable if a box securing device were provided that used a plurality of straps, but that used only one lock for the plurality of straps.

Additional prior art in apparatuses and methods relating to packaging and packages is disclosed in the following U.S. Pat. Nos. 3,639,530 of Ryan; 3,957,141 of Domes; 3,964,654 of Wittenberger; 5,009,055 of Simmons; and U.S. Pat. No. Des. 249,825 of Hasulak.

U.S. Pat. No. 3,639,530 of Ryan discloses a method of manufacture of a high tenacity resinous packaging strap. U.S. Pat. No. 3,957,141 of Domes discloses a briefcase having a compartment for storing an umbrella which is accessible from the outside of the briefcase. U.S. Pat. No. 3,964,654 of Wittenberger discloses pack straps used to secure a pack of the like to a human body. U.S. Pat. No. 5,009,055 of Simmons discloses a complex apparatus for wrapping bundles and newspapers. And U.S. Pat. No. Des. 249,825 of Hasulak discloses a design for a briefcase. None of these patents address the problems of closing, opening, reclosing, and reopening of boxes and shipping containers discussed above.

Thus, while the foregoing body of prior art indicates it to be well known to use boxes for shipping and to use ropes, wrapping paper, and tape for closing the boxes, the provision of a more simple and cost effective device is not contemplated. Nor does the prior art described above teach or suggest a box closing apparatus that permits easy closing, opening, reclosing, and reopening of the boxes. Also, the prior art does not provide a box closing and sealing apparatus that permits easy closing, opening, reclosing, and reopening of the boxes and the like without destroying the materials used to close the boxes. The prior art does not provide a box closing apparatus which is reusable and permits reclosing of opened boxes without the need for new box closing materials.

In addition, the prior art does not provide a box closing apparatus that is easy to use in a stressful environment such as a Customs inspection. The prior art does not provide a box-closing apparatus that provides protection against being broken into. Neither does the prior art provide a box closing apparatus that provides protection against the box rupturing during shipping. Also, the prior art does not provide a box securing device that uses a plurality of straps, but that uses only one key or combination lock for the plurality of straps. In addition, the prior art does not provide a box closing apparatus which includes an audible alarm that sounds when unauthorized entry is attempted.

The foregoing disadvantages are overcome by the unique box protection apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a box protection apparatus that includes a plurality of flexible straps for encompassing the box under tension, and a guide for receiving the straps and for orienting the straps with respect to the box. The guide includes a rectangular frame member which includes a plurality of slots for receiving the box-encompassing straps. A hinged lid is provided for covering the frame member. The frame member includes a first locking member, and the lid includes a second locking member whereby the frame member and the lid can be locked together. The frame member includes at least one handle. Buckles are provided for locking the straps under tension, and the buckles are covered by the lid when the lid is locked to the frame member. The box protection apparatus may also include an alarm assembly, connected to either the frame member or the lid, for sounding an alarm in response to unauthorized moving of the lid. A key-controlled override device is provided for preventing the alarm from sounding when an authorized moving of the lid takes place. The box protection apparatus may also include a dye-releasing assembly, connected to the frame member, for releasing dye in response to unauthorized moving of the lid. A key-controlled override device is provided for preventing the dye from being released when an authorized moving of the lid takes place.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved box protection apparatus which has all of the advantages of the prior art and none of the disadvantages.

It is another object of the present invention to provide a new and improved box protection apparatus which may be easily and efficiently manufactured and marketed.

It is a further object of the present invention to provide a new and improved box protection apparatus which is of durable and reliable construction.

An even further object of the present invention is to provide a new and improved box protection apparatus which is susceptible of a low cost of manufacture with regard to both materials and labor, and which accordingly is then susceptible of low prices of sale to the consuming public, thereby making such box protection apparatus available to the buying public.

Still yet a further object of the present invention is to provide a new and improved box protection apparatus that permits easy closing, opening, reclosing, and reopening of the boxes.

Still another object of the present invention is to provide a new and improved box protection apparatus permits easy closing, opening, reclosing, and reopening of the boxes and the like without destroying the materials used to close the boxes.

Yet another object of the present invention is to provide a new and improved box protection apparatus which is reusable and permits reclosing of opened boxes without the need for new box closing materials.

Even another object of the present invention is to provide a new and improved box protection apparatus that is easy to use in a stressful environment such as a Customs inspection.

Still a further object of the present invention is to provide a new and improved box protection apparatus that provides protection against the box being broken into.

Yet another object of the present invention is to provide a new and improved box protection apparatus that provides protection against the box rupturing during shipping.

Still another object of the present invention is to provide a new and improved box protection apparatus that employs a plurality of straps, but that employs only one lock for the plurality of straps.

Yet another object of the present invention is to provide a new and improved box protection apparatus that provides an audible alarm when unauthorized entry of the box is attempted.

These together with still other objects of the invention, along with the various features of novelty which characterize the invention, are pointed out with particularity in the claims to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
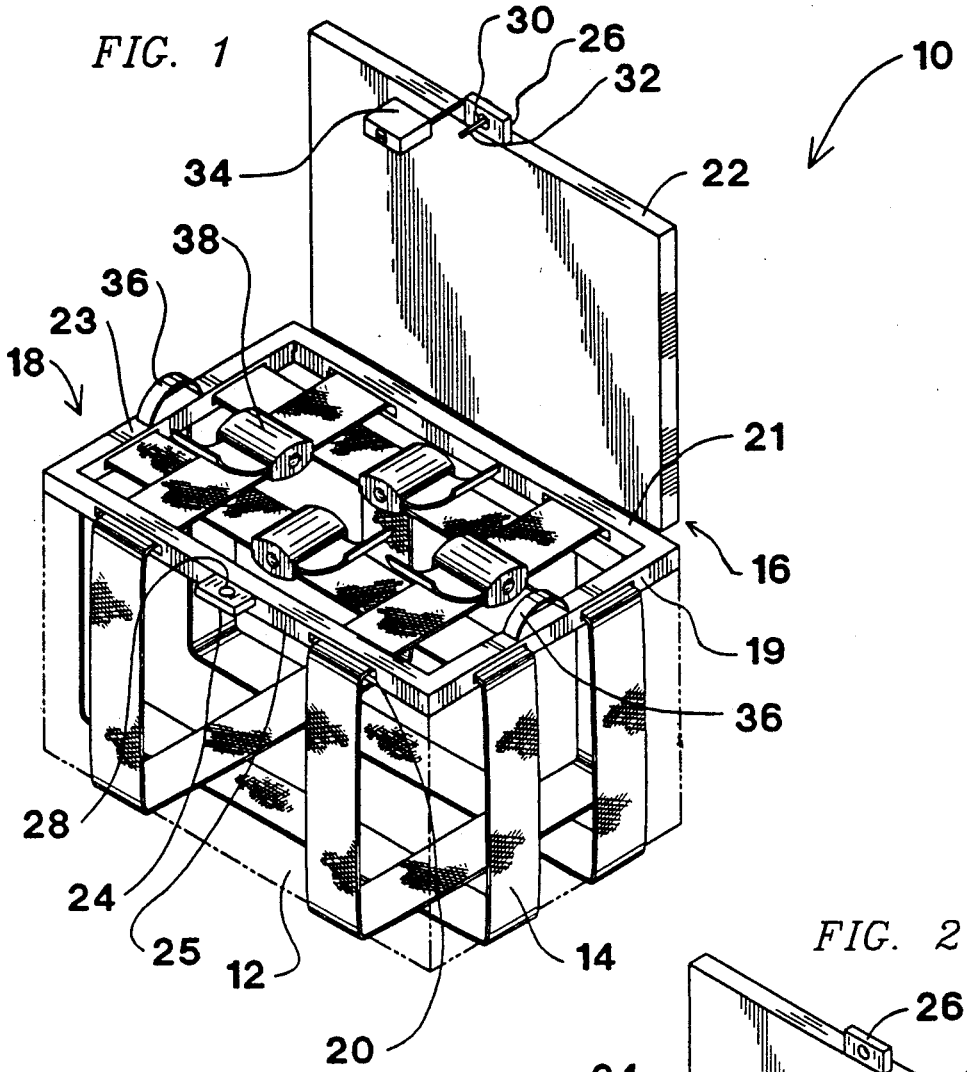
FIG. 1 is a perspective view showing a first preferred embodiment of the box protection apparatus of the invention installed on a box.
Figure 2:
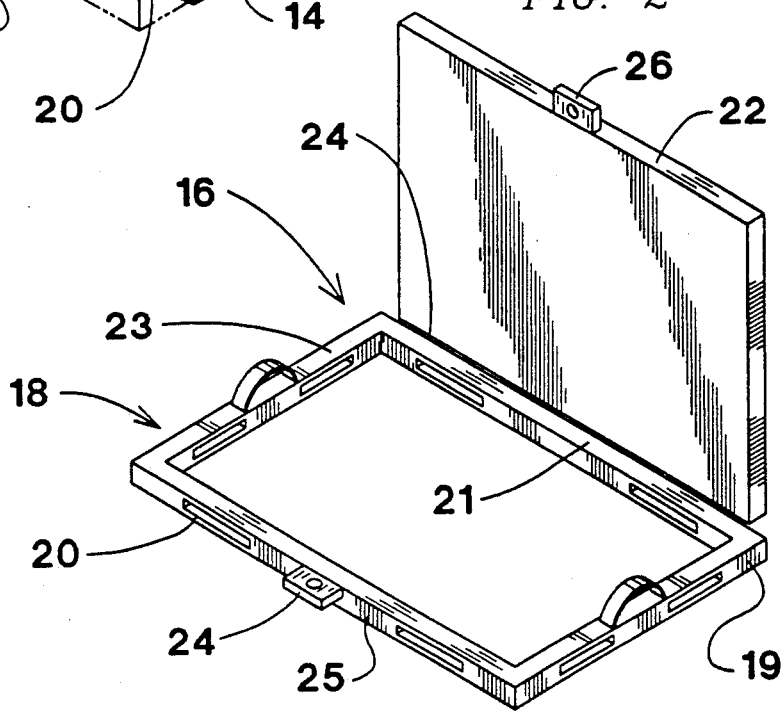
FIG. 2 is a perspective view of frame member and lid of the embodiment of the box protection apparatus shown in FIG. 1.
Figure 3:
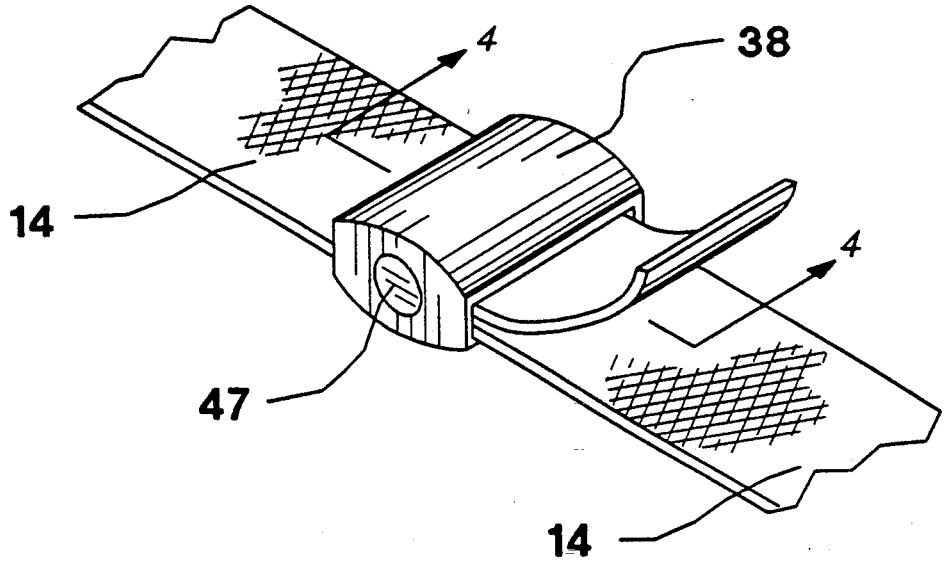
FIG. 3 is an enlarged perspective view of a buckle used for a strap in the embodiment shown in FIG. 1.

With reference to the drawings, a new and improved box protection apparatus embodying the principles and concepts of the present invention will be described.

Turning initially to FIGS. 1–4, there is shown a first exemplary embodiment of the box protection apparatus of the invention generally designated by reference numeral 10. In its preferred form, box protection apparatus 10 encompasses box 12 (shown in phantom form) and is comprised of a plurality of flexible straps 14 for encompassing the box 12, and a guide assembly 16, for receiving the straps 14, and for orienting the straps 14 with respect to the box 12. The straps 14 include locking buckles 38 for locking the straps 14 under tension around the box 12.

The guide assembly 16 includes a rectangular frame member 18 which includes a plurality of slots 20 for receiving the straps 14. The guide assembly 16 also includes a lid 22 for covering the frame member 18. A hinge 24 connects the lid 22 to the frame member 18.

The frame member 18 includes a first locking member, and the lid 22 includes a second locking member, such that the frame member 18 and the lid 22 are locked together by locking the first locking member and the second locking member More specifically, the first locking member includes a first flange 24 which includes a first aperture 28. The second locking member includes a second flange 26 that includes a second aperture 30 that is connected to the lid 22. The first aperture 28 and the second aperture 30 are capable of receiving a shackle 32 of a padlock 34 for locking the frame member 18 and the lid 22 together.

The frame member 18 includes two handles 36. The straps 14 include locking buckles 38 for locking the straps 14 under tension around the box 12. The strap tension locking buckles 38 are covered by the lid 22 when the lid 22 is locked to the frame member 18 (not shown). Thus, only one padlock 34 need be used to protect a plurality of buckles 38.

Figure 4:
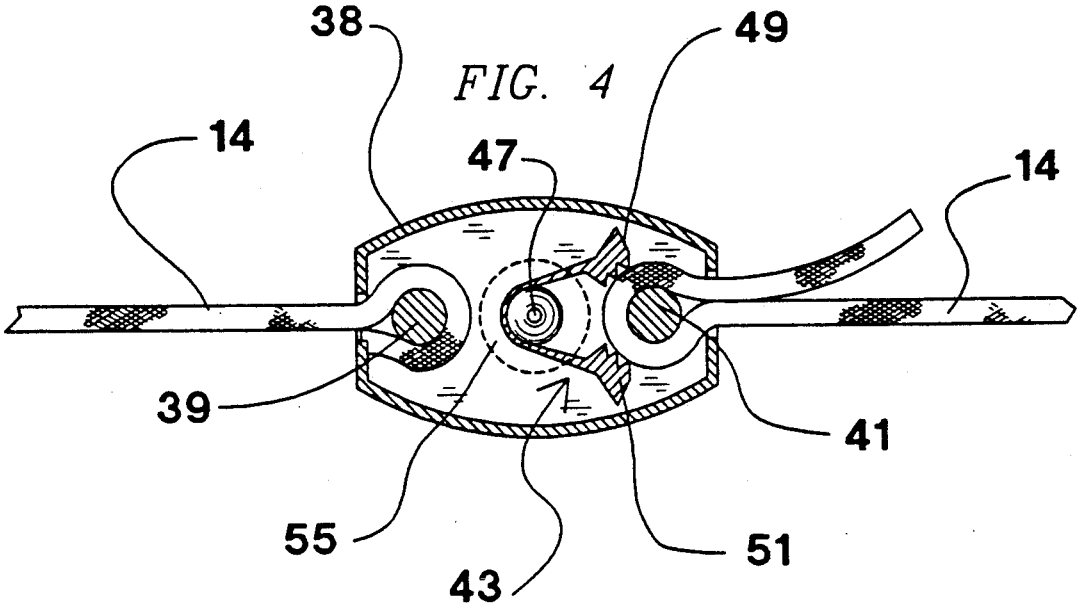
FIG. 4 is cross-sectional view of the buckle shown in FIG. 3 taken along the line 3—3 thereof.

As shown in FIG. 4, the locking mechanism of the buckle 38 includes a first strap holder 39 for holding one end of the strap 14 and a second strap holder 41 for holding the other end of the strap 14. The strap locking mechanism is comprised of an expandable, tooth-jawed spring 43 that is particularly wrapped around the spring-supporting, conical shaft 55. Without the button 47 is pushed in, the conical shaft 55 is moved between the jaws 49 and 51 of the spring 43, and the jaws 49 and 51 disengage from the strap 14, thereby permitting the tension in the strap 14 to be increased or decreased.

In employing the embodiment of the box protection apparatus 10 of the invention shown in FIGS. 1–4, free ends of the straps 14 are first threaded through slots on two respective perpendicular sides of the frame member 18 of the guide assembly 16. For example, the free ends of corresponding straps 14 are first threaded through respective perpendicular sides 19 and 21 of the frame member 18. Then, the free ends of the straps 14 are laid out on the floor in grid or matrix pattern shown in FIG. 1. The box 12 is then placed on the grid pattern of straps 14 on the floor. The guide assembly 16, with the lid 22 in the open position, and with the straps 14 already threaded through perpendicular sides 19 and 21, is placed on top of the box 12. Then the free ends of the straps 14 are passed through the slots on the respective two sides 23 and 25 opposing the perpendicular sides 19 and 21. The free ends of the straps 14 are then passed into the respective buckles 38 and pulled on to provide appropriate tension. When the straps 14 are appropriately tensioned, the guide member 16 of the invention is secured to the box 12. Then the lid 22 can be closed, and the shackle 32 of the padlock 34 passed through the apertures 28 and 30 on the respective first and second flanges 24 and 26. When the shackle 32 is locked into the padlock 34, the lid is secured to the frame member 18, and access to the buckles 38 is prevented.

The box protection apparatus 10 of the invention can be easily used to close a box 12 as described above. The box protection 10 of the invention can be easily removed from the box 12 for a Customs inspection so that the box 12 can be opened by simply unlocking the padlock 34, lifting the lid 22, relieving strap tension from the buckles 38, removing free ends of the straps from the slots 20 in the respective perpendicular sides 23 and 25, and lifting the guide assembly 16 off of the box 12. Once the inspection is over, the guide assembly 16 can be replaced on top of the box 12, and the free ends of the straps 14 can be passed back through the slots 20 in the respective sides 23 and 25, passed through the buckles 38, and tensioned as described above. Then the lid 22 can be readily closed and the padlock 34 readily relocked.

Thus, it is readily apparent, that by using the box protection apparatus 10 of the invention, a box 12 can be easily closed and protected, opened, and reclosed, etc. in a short period of time without requiring additional packaging materials. Moreover, the box protection apparatus 10 of the invention can be used and reused many times in a rapid and efficient manner.

In addition, the tensioned straps 14 and the guide assembly 16 provide quite a lot of structural strength to protect the box 12 from rupturing and unauthorized entry.

Figure 5:
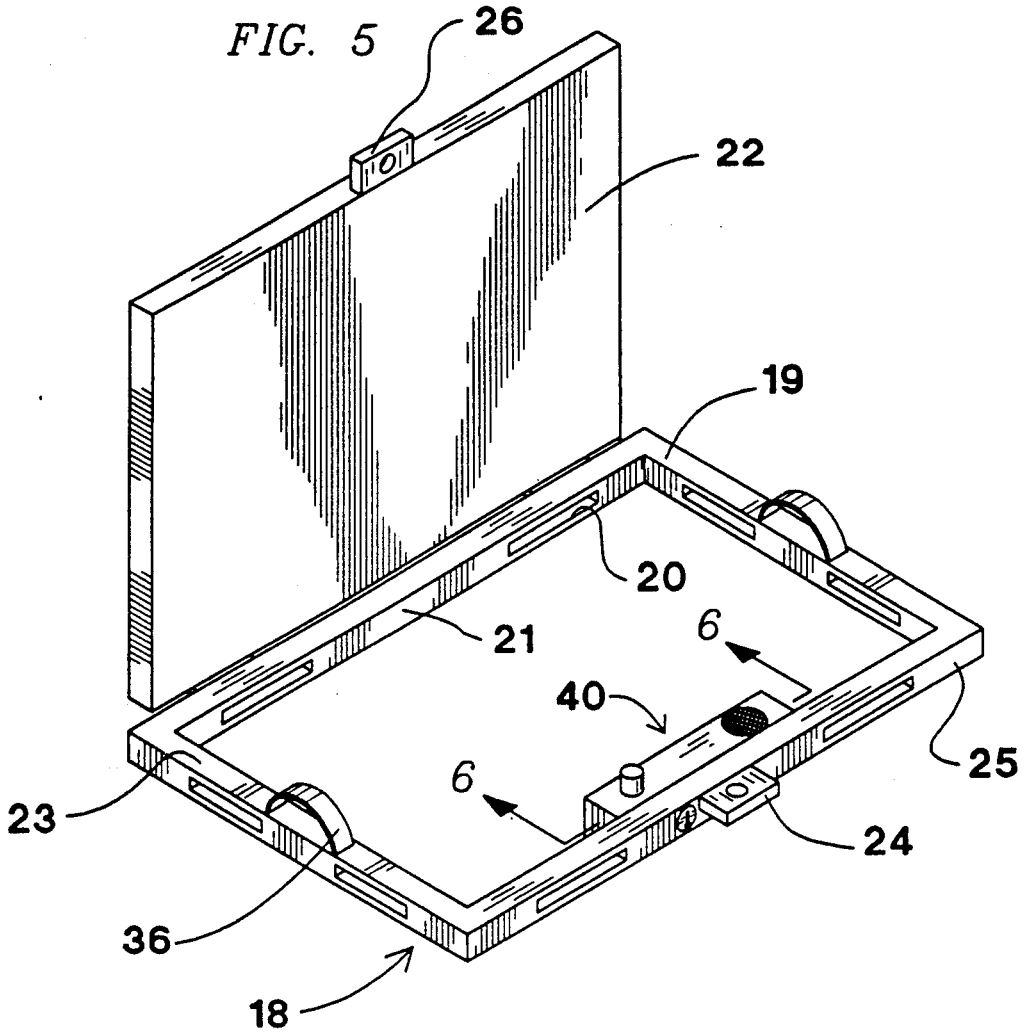
FIG. 5 is a perspective view of a second preferred embodiment of the box protection apparatus of the invention which includes an audible alarm assembly.
Figure 6:
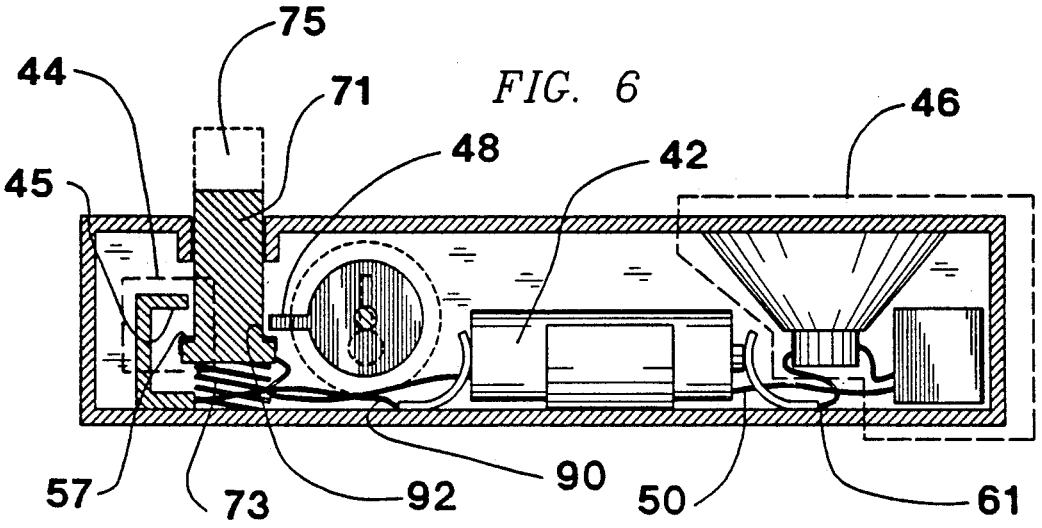
FIG. 6 is a cross-sectional view of the embodiment of the box protection apparatus of the invention shown in FIG. 5 taken along the line 6—6 thereof.

Turning to FIGS. 5 and 6, a second embodiment of the box protection apparatus 10 of the invention is shown. Reference numerals are shown that correspond to like reference numerals that designate like elements shown in the other figures. In addition, alarm assembly 40 is connected to the frame member 18 and is provided for sounding an alarm in response to unauthorized moving of the lid 22 with respect to the frame member 18.

The alarm assembly 40 includes a battery power source 42 and a switch 44 having a first contact 45 connected to the power source 42 via wire 90. The switch 44 is controlled by a plunger 71 which is biased in the upward direction by spring 73. When the lid 22 is raised (thereby moving away from frame member 18), the plunger 71 moves to the position 75 shown in dotted outline, and the contacts 45 and 57 of switch 44 come into contact (that is switch 44 closes), completing a circuit and causing a sound generating assembly 46 to give off an audible alarm signal.

More specifically, the sound generating assembly 46 has a first lead 50 connected to a second contact 57 of the switch 44 and has a second lead 61 connected to the power source 42. A key-controlled override cam 48 is provided for authorized opening of the switch 44 when an authorized moving of the lid 22 with respect to the frame member 18 takes place. More specifically, when cam 48 is placed in the horizontal orientation shown in FIG. 6, the plunger 71 is prevented from moving upward to position 75 even though the lid 22 is raised. Flange 92 butts up against the cam 48, and the cam 48 prevents the plunger 71 from rising. Thereby, switch 44 is prevented from closing even though the lid 22 is raised. On the other hand, when it is desired that the alarm assembly 40 monitor unauthorized tampering, then the cam 48 is moved by means of the key lock to a vertical orientation, thereby permitting the plunger 71 to rise to the position 75 is the event that the lid is opened in an unauthorized manner. The sound generating assembly 46 includes a speaker 54 and siren circuitry 56.

Figure 7:
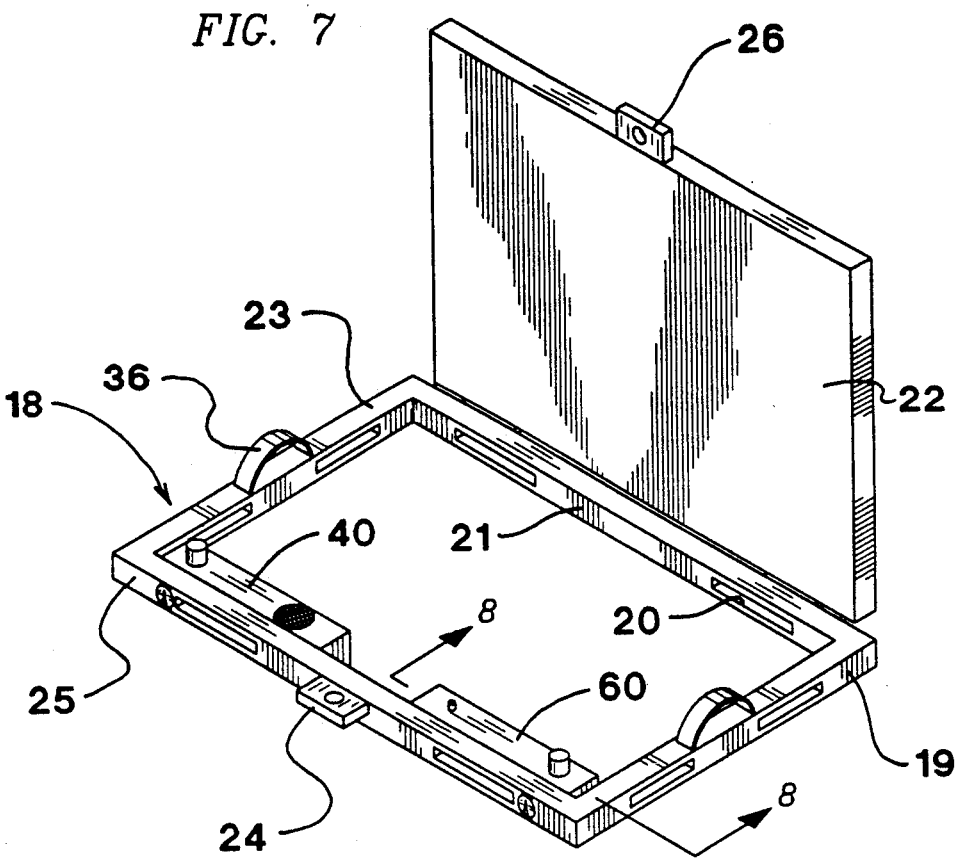
FIG. 7 is a perspective view of a third preferred embodiment of the box protection apparatus of the invention which includes a dye-releasing assembly.
Figure 8:
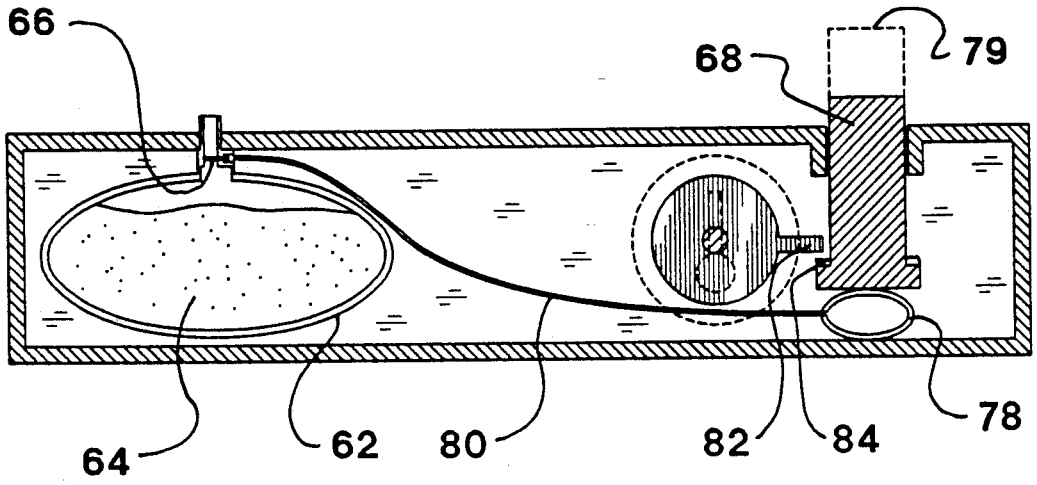
FIG. 8 is a cross-sectional view of the embodiment of the box protection apparatus of the invention shown in FIG. 7 taken along the line 8—8 thereof.

Turning to FIGS. 7 and 8, a third embodiment of the box protection apparatus 10 of the invention is shown. Reference numerals are shown that correspond to like reference numerals that designate like elements shown in the other figures. In addition, dye-releasing assembly 60 is connected to the frame member 18 and is provided for releasing dye 64 in response to unauthorized moving of the lid 22 with respect to the frame member 18.

The dye-releasing assembly 60 includes a container 62 of dye 64 under pressure. A movable valve 66, when closed, retains the dye 64 under pressure in the container 62. A plunger 68 is responsive to unauthorized moving of the lid 22 with respect to the frame member 18 and controls the movable valve 66 for releasing dye 64 from the container 62 when unauthorized moving of the lid 22 takes place. More specifically, the bottom of plunger 68 is used to compress a fluid-containing bulb 78 when the lid 22 is closed. The pressure in the bulb 78 is transmitted through line 80 to the valve 66 and keeps the valve 66 in the closed position.

However, when the lid 22 is opened with respect to the frame member 18, the plunger 68 moves to the position 79 shown in dotted outline in FIG. 8, the pressure in the bulb 78 is reduced, and the reduction of the pressure in the bulb is transmitted through line 80 to the valve 66 causing the valve 66 to move to the open position, thereby permitting pressurized dye 64 to be released from container 62.

A key-controlled override cam 82 is provided for authorized moving of the lid 22 with respect to the frame member 18. The key-controlled cam 82, when in the horizontal position shown, prevents the plunger 68 from controlling the movable valve 66 for releasing dye 64 from the container 62 when authorized moving of the lid 22 takes place. More specifically, the cam 82 contacts flange 84 on the plunger 68, as shown in FIG. 8, when opening of the lid 22 is authorized. In this plunger position, the bulb 78 remains compressed, and the valve 66 remains closed. However, when the dye-releasing assembly 60 is to be armed, the lid 22 is close, and the key-controlled cam 82 is moved to a vertical position. Then, if the lid 22 is opened without authorization, the plunger is pushed up by bulb 78 to the position 79, and the valve 66 is moved to release dye 64 from the container 62.

It is apparent from the above that the present invention accomplishes all of the objects set forth by providing a new and improved box protection apparatus that is low in cost, relatively simple in design and operation, and which may advantageously be used for opening and closing boxes and for protecting boxes from damage or tampering during shipping.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be most practical and preferred embodiment (s) of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the Unites States is as follows:

1. Apparatus for protecting a box, comprising:

a plurality of flexible means for encompassing said box; and guide means, for receiving said flexible box encompassing means, and for orienting said flexible box encompassing means with respect to the box, wherein said guide means includes a plurality of slots for receiving said flexible encompassing means, further including a lid adapted to be closed relative to said guide means for covering said guide means, wherein said encompassing means include locking means for locking said encompassing means under tension; and said encompassing means locking means are covered by said lid when said lid is closed relative to said guide means.

2. The apparatus described in claim 1 wherein said flexible box encompassing means include straps.

3. The apparatus described in claim 2 wherein said straps include locking means for locking straps under tension.

4. The apparatus described in claim 1 wherein said guide means includes a rectangular frame member, and said slots for receiving said flexible box encompassing means are located in said frame member.

5. The apparatus described in claim 4 wherein said lid is adapted to cover said frame member, further including a hinge for connecting said lid to said rectangular frame member.

6. The apparatus described in claim 4, wherein:

said frame member includes a first locking member; and said lid includes a second locking member;

said frame member and said lid being adapted to be locked together by locking said first locking member and said second locking member together.

7. The apparatus described in claim 6 wherein:

said first locking member includes a first flange that includes a first aperture and that is connected to said frame member; and said second locking member includes a second flange that includes a second aperture and that is connected to said lid;

such that said first aperture and said second aperture are capable of receiving a shackle of a padlock for locking said frame member and said lid together.

8. The apparatus described in claim 1 wherein said frame member includes at least one handle.

9. The apparatus described in claim 1, further including:

alarm assembly means, connected to said frame member, for sounding an alarm in response to unauthorized moving of said lid with respect to said frame member.

10. The apparatus described in claim 9, wherein said alarm assembly means includes:

a battery power source;

a switch having a first contact connected to said power source, wherein said switch responds to moving said lid with respect to said frame member;

a sound generating assembly having a first lead connected to a second contact of said switch and having a second lead connected to said power source;

such that said switch closes upon unauthorized moving of said lid with respect to said frame member and said sound generating assembly generates an audible alarm signal when said switch closes.

11. The apparatus described in claim 10, further including a key-controlled means for authorized opening of said switch when an authorized moving of said lid with respect to said frame member takes place.

12. The apparatus described in claim 10 wherein said sound generating assembly includes a speaker and siren circuitry.

13. The apparatus described in claim 1, further including:

a dye releasing assembly means, connected to said frame member, for releasing dye in response to unauthorized moving of said lid with respect to said frame member.

14. The apparatus described in claim 13 wherein said dye releasing assembly means includes:

a container of dye under pressure;

a movable valve retaining said dye under pressure in said container;

plunger means, responsive to unauthorized moving of said lid with respect to said frame member, for controlling said movable valve for releasing dye from said container when unauthorized moving of said lid takes place;

a key-controlled means for authorized moving of said lid with respect to said frame member, said key-controlled means preventing said plunger means from controlling said movable valve for releasing dye from said container when authorized moving of said lid takes place.

* * * * *